US008132609B2

(12) United States Patent
Kirby

(10) Patent No.: US 8,132,609 B2
(45) **Date of Patent: *Mar. 13, 2012**

(54) ROLLER SHADE SYSTEM HAVING A PLEATED FABRIC

(75) Inventor: David A. Kirby, Zionsville, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/862,231

(22) Filed: Aug. 24, 2010

(65) Prior Publication Data

US 2010/0314052 A1 Dec. 16, 2010

Related U.S. Application Data

(63) Continuation of application No. 12/193,089, filed on Aug. 18, 2008, now Pat. No. 7,802,609.

(51) Int. Cl.
*A47G 5/02* (2006.01)
*A47H 1/00* (2006.01)
*A47H 13/14* (2006.01)

(52) U.S. Cl. ..... 160/238; 160/348

(58) Field of Classification Search ..... 160/310, 160/348, 238, 352, 23.1, 32, 84.01; 242/615, 242/615.3; 223/85, 95, 88, 96, 28–36; 38/12, 38/102.91; 112/147, 145, 146; 493/427, 493/442, 480, 446–448
See application file for complete search history.

(56) References Cited

U.S. PATENT DOCUMENTS

| | | | | |
|---|---|---|---|---|
| 85,922 | A | 1/1869 | Fuzzard | |
| 128,722 | A | 7/1872 | Gird | |
| 774,641 | A * | 11/1904 | Barkhurst | 160/88 |
| 1,549,535 | A * | 8/1925 | Gray | 160/126 |
| 3,116,097 | A | 12/1963 | Novales | |
| 3,160,202 | A * | 12/1964 | Rosen | 160/344 |
| 3,783,456 | A | 1/1974 | Doan | |
| 3,784,186 | A | 1/1974 | Lenthall et al. | |

(Continued)

FOREIGN PATENT DOCUMENTS

GB 2112273 A 7/1983

OTHER PUBLICATIONS

European Patent Office, International Search Report and Written Opinion for International Patent Application No. PCT/US2009/053393, Jul. 7, 2011, 10 pages.

*Primary Examiner* — Blair M Johnson
*Assistant Examiner* — Jaime F Cardenas-Garcia
(74) *Attorney, Agent, or Firm* — Mark E. Rose; Philip N. Smith; Bridget L. McDonough

(57) ABSTRACT

A pleated roller shade system allows a thin flexible shade fabric, such as, for example, silk, to be wrapped around a roller tube. The system comprises a pleating bar mounted parallel to the roller tube and having a fabric-receiving opening that defines, for example, a serpentine path. The shade fabric is received through the fabric-receiving opening and is folded by the pleating bar, such that the shade fabric is wrapped around the roller tube in folds as the roller tube rotates. The shade fabric is neatly wrapped around the roller tube (i.e., bunching of the shade fabric is avoided) and is stored out-of-sight when rolled up.

20 Claims, 6 Drawing Sheets

U.S. PATENT DOCUMENTS

| | | | | |
|---|---|---|---|---|
| 5,467,266 | A | 11/1995 | Jacobs et al. | |
| 6,100,659 | A | 8/2000 | Will et al. | |
| 6,155,326 | A | 12/2000 | Imhoff et al. | |
| 6,201,364 | B1 | 3/2001 | Will et al. | |
| 6,497,267 | B1 | 12/2002 | Azar et al. | |
| 6,845,806 | B2 | 1/2005 | Gottschall et al. | |
| 6,983,783 | B2 | 1/2006 | Carmen, Jr. et al. | |
| 7,063,124 | B2 | 6/2006 | Walker et al. | |
| 7,163,044 | B2 | 1/2007 | Kirby | |
| 7,281,565 | B2 | 10/2007 | Carmen, Jr. et al. | |
| 7,802,609 | B2 * | 9/2010 | Kirby | 160/238 |
| 2005/0205217 | A1 * | 9/2005 | Harper et al. | 160/89 |
| 2010/0043985 | A1 | 2/2010 | Kirby et al. | |
| 2010/0269983 | A1 | 10/2010 | Kirby | |

* cited by examiner

ROLLER SHADE SYSTEM HAVING A PLEATED FABRIC

CROSS REFERENCE TO RELATED APPLICATIONS

This application is a continuation of, commonly-assigned U.S. patent application Ser. No. 12/193,089, filed Aug. 18, 2008, now U.S. Pat. No. 7,802,609, entitled ROLLER SHADE SYSTEM HAVING A PLEATED SHADE FABRIC, the entire disclosure of which is hereby incorporated by reference.

BACKGROUND OF THE INVENTION

1. Field of the Invention

The present invention relates to a motorized window treatment, and more particularly, to a motorized roller shade system for winding receipt of a thin, pleated fabric around a roller tube.

2. Description of the Related Art

Typical window treatments, such as, for example, roller shades, draperies, roman shades, and venetian blinds, are mounted in front of windows to prevent sunlight from entering a space and to provide privacy. A roller shade includes a flexible shade fabric wound onto an elongated roller tube. The flexible shade fabric typically includes a weighted hem bar at a lower end of the shade fabric, such that the shade fabric hangs in front of the window. Motorized roller shades include a drive system engaging the roller tube to provide for tube rotation, such that the lower end of the shade fabric can be raised and lowered (i.e., moved in a vertical direction) by rotating the roller tube.

Many thin and flexible fabrics, such as, for example, silk, are not suitable for use with prior art roller shades, since the thin fabrics tend to not hang flat and tend not to roll up evenly on the roller tube. Therefore, such thin fabrics are typically laminated to a stiffer backing to be wound about a roller tube. While the lamination allows the thin fabrics to be used with a roller shade, the thin fabrics loose their soft look and feel as a result of this process.

Prior art draperies have allowed for horizontal movement of a suspended pleated drapery fabric covering a window or other opening. These prior art draperies have required additional space to be provided on the sides of the window or opening to hold the drapery fabric when the drapery is fully open. This prevents the draperies from being used to cover windows where there is little space at the sides of the windows.

Accordingly, there is a need for roller shade system having a thin, flexible shade fabric that allows the shade fabric to hang with pleats and to be wrapped around a roller tube (i.e., moved in a vertical direction).

SUMMARY OF THE INVENTION

According to an embodiment of the present invention, a roller shade system adapted to be mounted in front of a window comprises a rotatably-mounted roller tube, a flexible shade fabric windingly received around the roller tube, and a pleating bar. The shade fabric is adapted to hang in front of the window has a first fabric end connected to the roller tube and a second fabric end opposite the first fabric end. The second fabric end is adapted to move in a vertical direction to raise and lower the shade fabric as the roller tube is rotated in respective first and second directions. The pleating bar defines a fabric-receiving opening and is mounted such that the shade fabric is received through the fabric-receiving opening that has a non-linear path, such that the shade fabric hangs in front of the window with a plurality of pleats. The second fabric end moves in an upwards direction as the roller tube rotates in the first direction and in a downward direction as the roller tube rotates in the second direction.

According to another aspect of the present invention, a method of covering a window with a flexible shade fabric comprising the steps of: (1) windingly receiving the flexible shade fabric around a rotatably-mounted roller tube, the shade fabric having a first fabric end connected to the roller tube and a second fabric end opposite the first fabric end; (2) receiving the shade fabric through a fabric-receiving opening of a pleating bar, the fabric-receiving opening having a non-linear path, such that the shade fabric hangs in front of the window with a plurality of pleats; (3) rotating the roller tube in a first direction to move the second fabric end in a vertical direction to raise the shade fabric; and (4) rotating the roller tube in a second direction to move the second fabric end in the vertical direction to lower the shade fabric.

Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
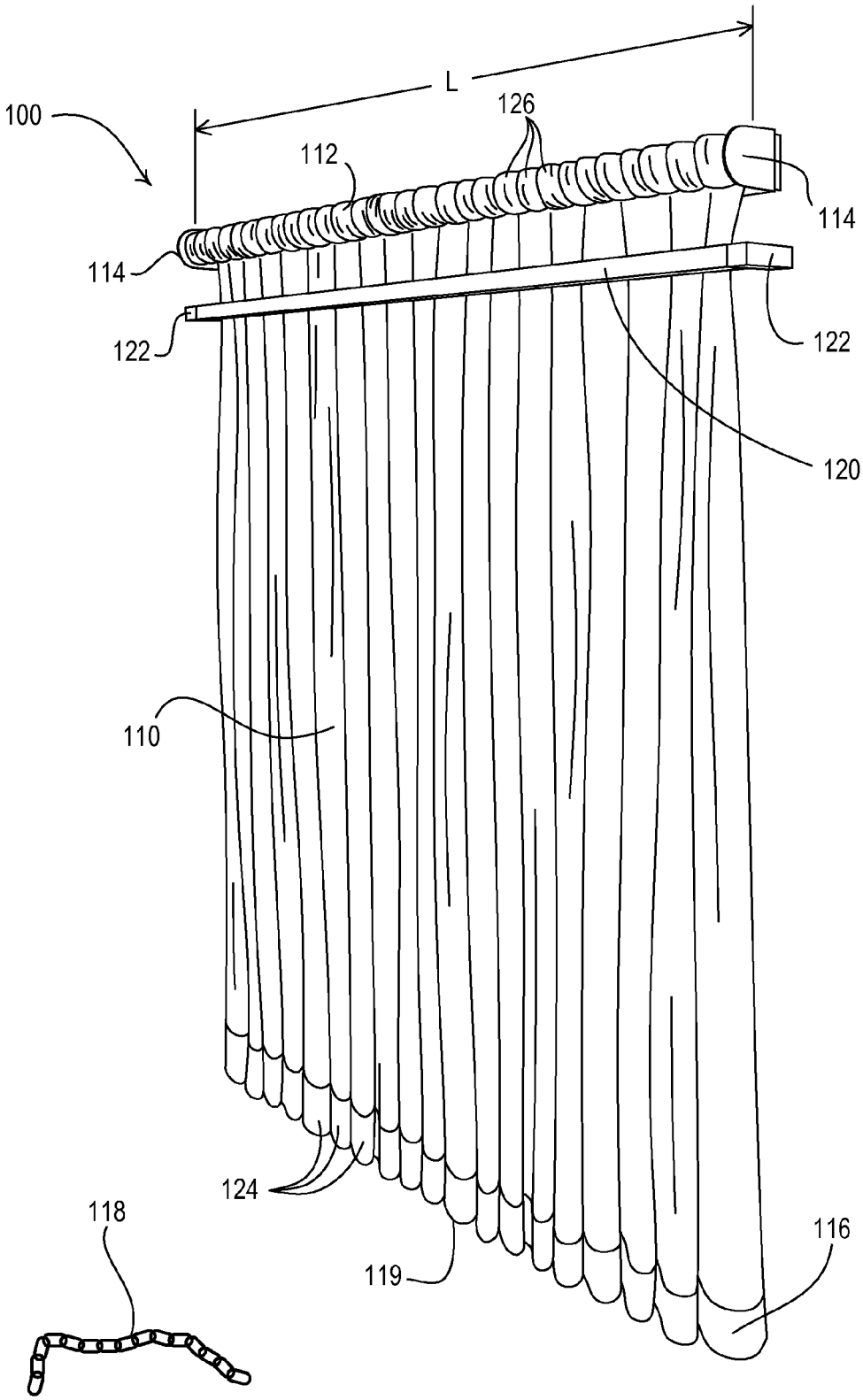
FIG. 1 is a perspective view of a pleated roller shade system having a pleated shade fabric according to a first embodiment of the present invention.

The foregoing summary, as well as the following detailed description of the embodiments of the present invention, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a perspective view of a pleated roller shade system 100 having a pleated shade fabric 110 that is windingly received around a roller tube 112 according to a first embodiment of the present invention. The shade fabric 110 has a first fabric end connected to the roller tube and a second fabric end opposite the first fabric end. The roller tube 112 has two opposite tube ends and extends between the opposite tube ends for a length L (as shown in FIG. 1). The roller tube 112 is rotatably coupled at the tube ends to two mounting brackets 114, which are connected to a vertical surface, e.g., a wall. The shade fabric 110 comprises a hem bar pocket 116 at a bottom edge 119 (i.e., the second fabric end) of the shade fabric. The hem bar pocket 116 is adapted to hold a weighting element, e.g., a flexible chain 118, such that the shade fabric 110 hangs from the roller tube 112. The bottom edge 119 of the shade fabric 110 moves in an upwards direction and in a downwards direction as the roller tube 112 rotates in respective first and second angular directions.

Figure 7:
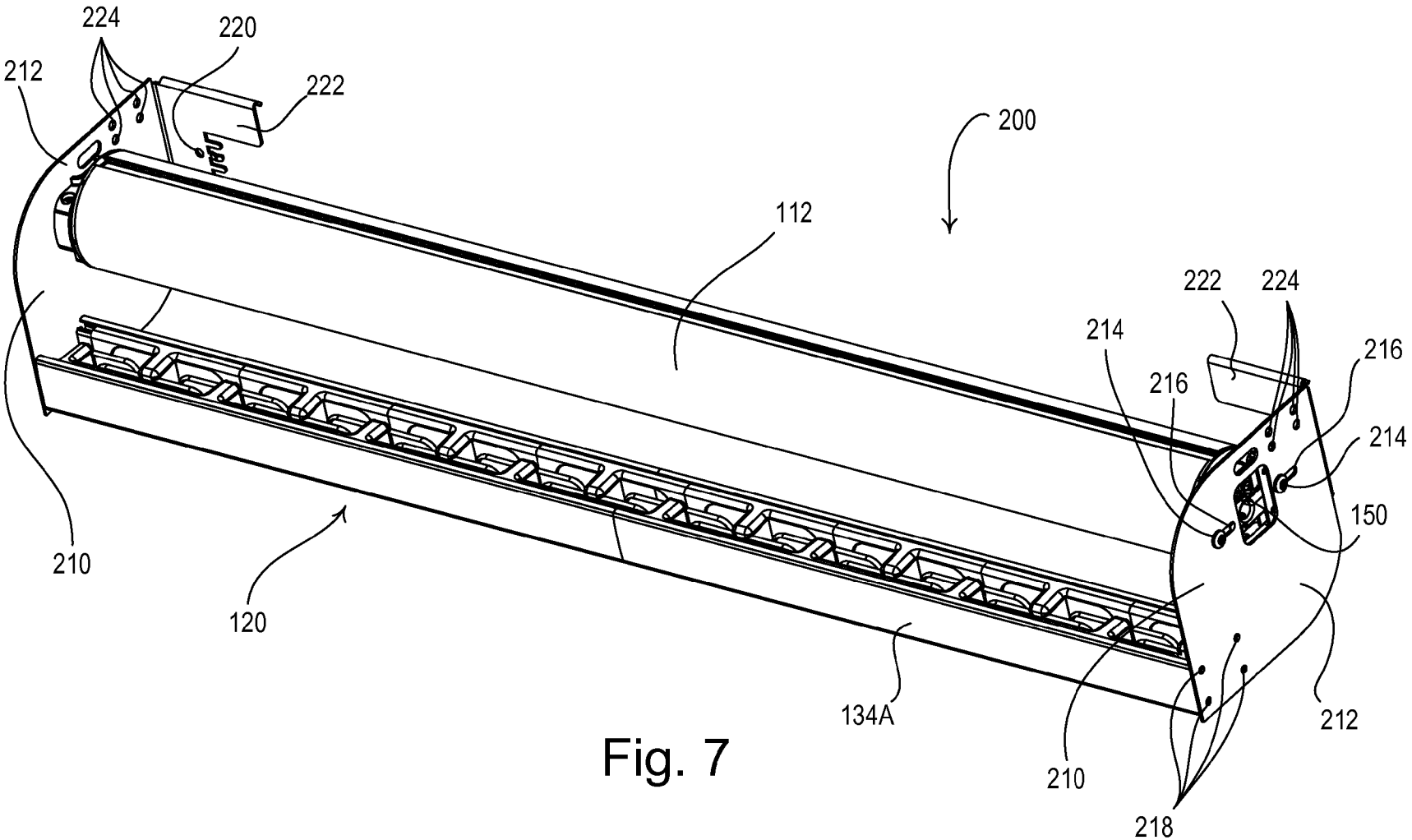
FIG. 7 is a perspective view of a pleated roller shade system according to a second embodiment of the present invention.

The pleated roller shade system 100 may also comprise a drive system (e.g., a motor drive unit 150 mounted inside the roller tube 112 as shown in FIG. 7) to allow for control of the rotation of the roller tube 112 by a user of the roller shade system. An example of the motor drive unit 150 is described in greater detail in U.S. Pat. No. 6,983,783, issued Jan. 10, 2006, entitled MOTORIZED SHADE CONTROL SYSTEM, the entire disclosure of which is hereby incorporated by reference.

The pleated roller shade system 100 further comprises a pleating bar 120, which is adapted to be mounted to the wall below the roller tube 112 via mounting ends 122. The shade fabric 110 slides through the pleating bar 120 as the roller tube 110 rotates resulting in the shade fabric hanging with a plurality of pleats 124. The pleating bar 120 operates to fold the shade fabric 110 into a plurality of folds 126 as the shade fabric is wound around the roller tube 112 (i.e., when the roller tube is rotated in the first angular direction to move the bottom edge 119 in the upwards direction). Alternatively, the roller tube 112 and the pleating bar 120 may be mounted to a horizontal surface (e.g., a ceiling), or between the sides of an opening (e.g., a window).

Figure 2:
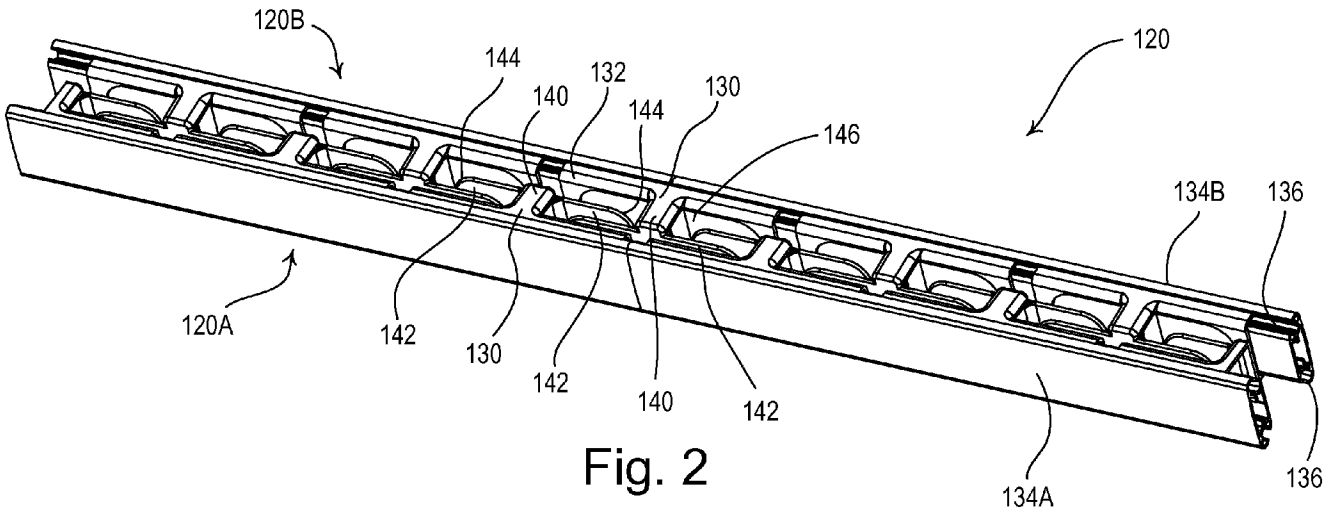
FIG. 2 is a perspective view of a portion of a pleating bar of the pleated roller shade system of FIG. 1.
Figure 3:
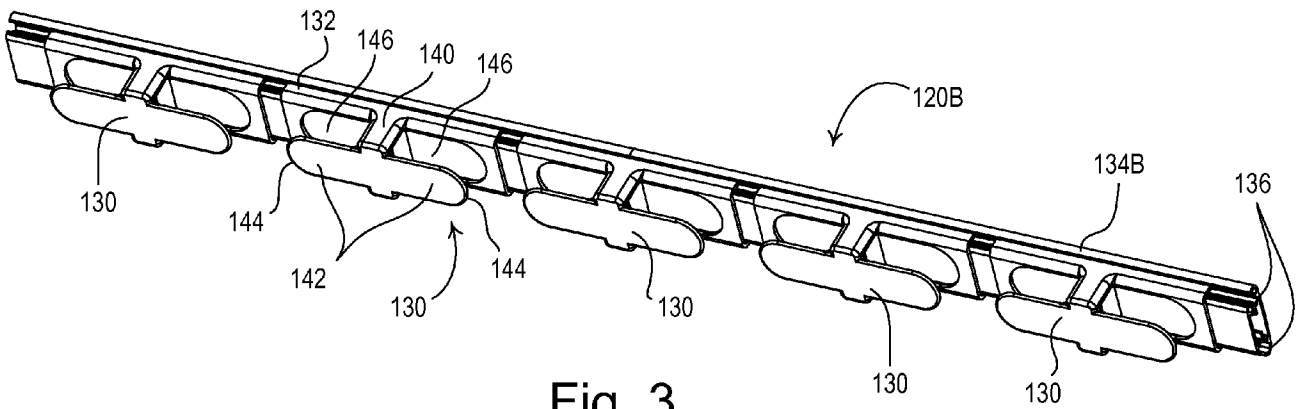
FIG. 3 is a perspective view of a portion of one of two pleating structures of the pleating bar of FIG. 2.
Figure 4:
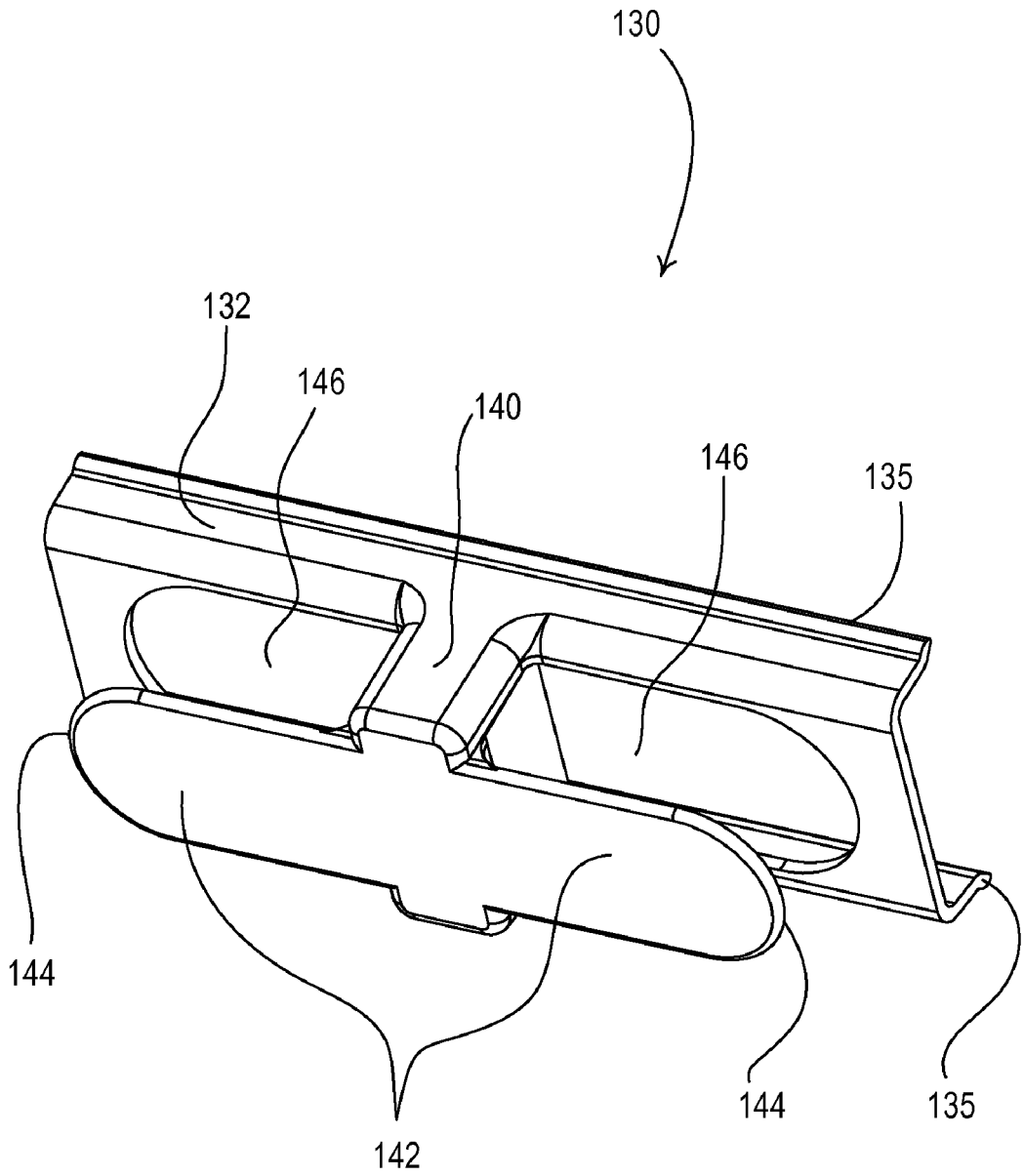
FIG. 4 is a perspective view of one of a plurality of pleating elements of the pleating bar of FIG. 2.

FIG. 2 is a perspective view of a portion of the pleating bar 120, which comprises two parallel pleating structures 120A, 120B. FIG. 3 is a perspective view of a portion of one of the pleating structures 120B of the pleating bar 120. FIG. 4 is a perspective view of one of a plurality of pleating elements 130 of the pleating bar 120.

Each pleating element 130 comprises a base 132 for mounting to one of two support bars 134A, 134B. The support bars 134A, 134B are oriented parallel to each other along the length of the pleating bar 120. Each of the pleating elements 130 has flanges 135 (FIG. 4) that are received within slots 136 of the supports bars 134A, 134B, such that the pleating elements 130 may be slid across the length of the support bars. The pleating elements 130 spaced apart at intervals from each other along the length of the supports bars 134A, 134B. The pleating elements 130 also have projections 140 that define, for example, "T-shaped" structures. Each projection 140 has two extensions 142 that are oriented parallel to the base 132 (i.e., parallel to the support bars 134A, 134B) and have rounded edges 144. A gap 146 is formed between the extensions 142 of the projections 140 and the base 132 of the pleating elements 130.

Figure 5:
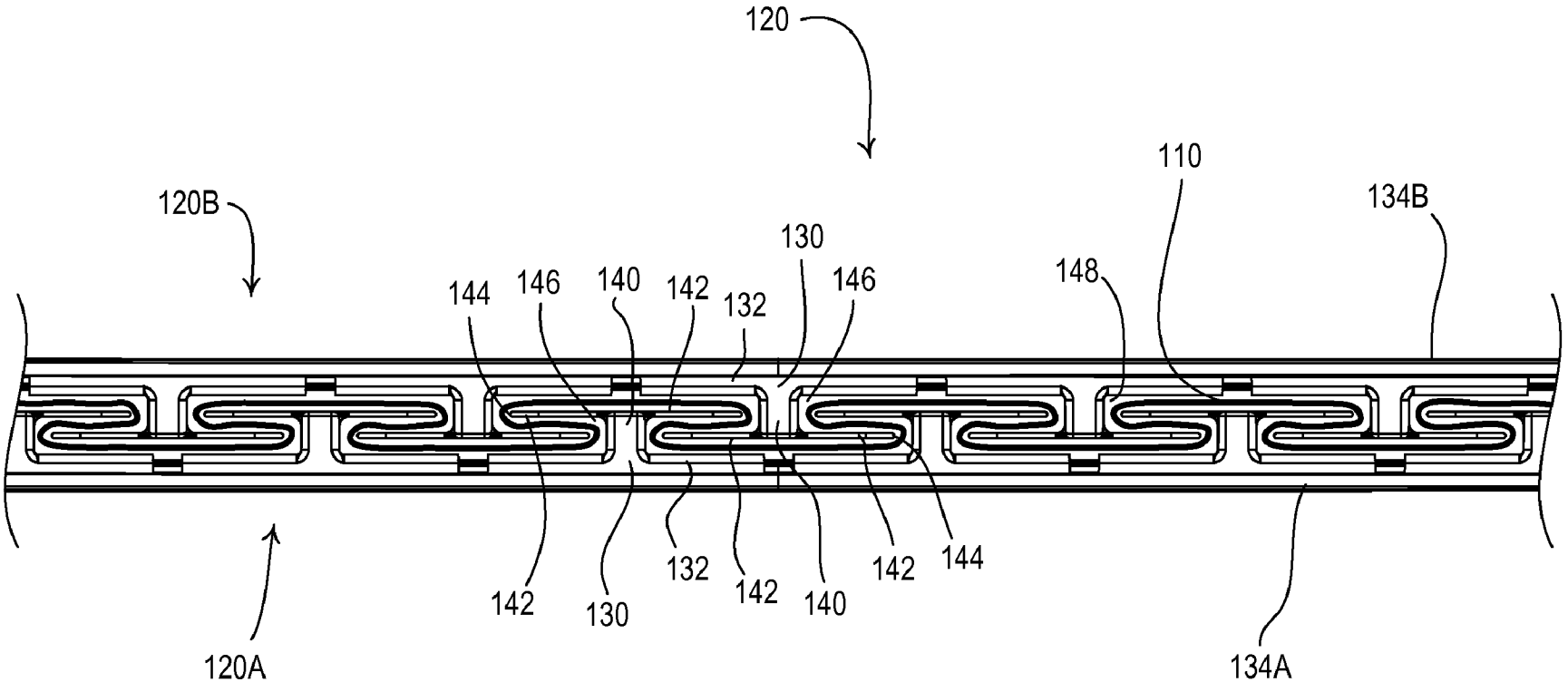
FIG. 5 is a partial top view of the pleating bar of FIG. 2 showing the shade fabric received through the pleating bar.

FIG. 5 is a partial top view of the pleating bar 130 showing the shade fabric 110 received through the pleating bar. The two parallel pleating structures 120A, 120B are mounted such that the projections 140 of the pleating elements 130 connected to the first and second support bars 132A, 132B extend towards the second and first support bars, respectively. The extensions 142 of the pleating elements 130 connected to the first support bar 134A are received within the gaps 146 of the pleating elements 130 connected to the second support bar 134B (and vice versa). Accordingly, a fabric-receiving opening 148 defining a non-linear path (e.g., a serpentine path) is provided between the two parallel pleating structures 120A, 120B. The shade fabric 110 is received through the fabric-receiving opening 148, such that the shade fabric assumes on a non-linear, serpentine shape when viewed from above as shown in FIG. 5.

FIG. 5 is a partial top view of the pleating bar 120 showing the shade fabric 110 received through the pleating bar. The two parallel pleating structures 120A, 120B are mounted such that the projections 140 of the pleating elements 130 connected to the first and second support bars 134A, 134B extend towards the second and first support bars, respectively. The extensions 142 of the pleating elements 130 connected to the first support bar 134A are received within the gaps 146 of the pleating elements 130 connected to the second support bar 134B (and vice versa). Accordingly, a fabric-receiving opening 148 defining a non-linear path (e.g., a serpentine path) is provided between the two parallel pleating structures 120A, 120B. The shade fabric 110 is received through the fabric-receiving opening 148, such that the shade fabric assumes on a non-linear, serpentine shape when viewed from above as shown in FIG. 5.

Because the projections 140 of the pleating elements 130 have T-shaped structures and the extensions 142 are provided in the gaps 146 of the pleating elements, there is overlap of the shade fabric 110 as the shade fabric wraps onto the roller tube 112 allowing the pleating bar 120 to fold the shade fabric 110 as the shade fabric wraps around the roller tube (i.e., into folds 126). Therefore, the thickness of shade fabric wrapped around the roller tube 112 is minimized and bunching of the shade fabric is avoided. Since the pleated shade fabric 110 is neatly wrapped around the roller tube 112 when rolled up, the shade fabric is stored out-of-sight from a user and no additional space is need for storage of the fabric (e.g., at sides of a window that the roller shade system 100 is covering). The rounded edges 144 of the extension 142 of the pleating elements 130 guide the shade fabric 110 through the fabric-receiving opening 148 without ripping or tearing the shade fabric.

Because the shade fabric 110 is folded as the shade fabric is wrapped around the roller tube 112, the total width of the unwrapped shade fabric is substantially greater than the length of the roller tube. For example, the total width of the unwrapped shade fabric 110 may be twice as long as the length of the roller tube 112. The width of the unwrapped shade fabric 110 is defined as the distance between the opposites sides of the shade fabric (i.e., measured in the same direction as the length of the roller tube 112 shown in FIG. 1) when the shade fabric is pulled taunt.

Figure 6:
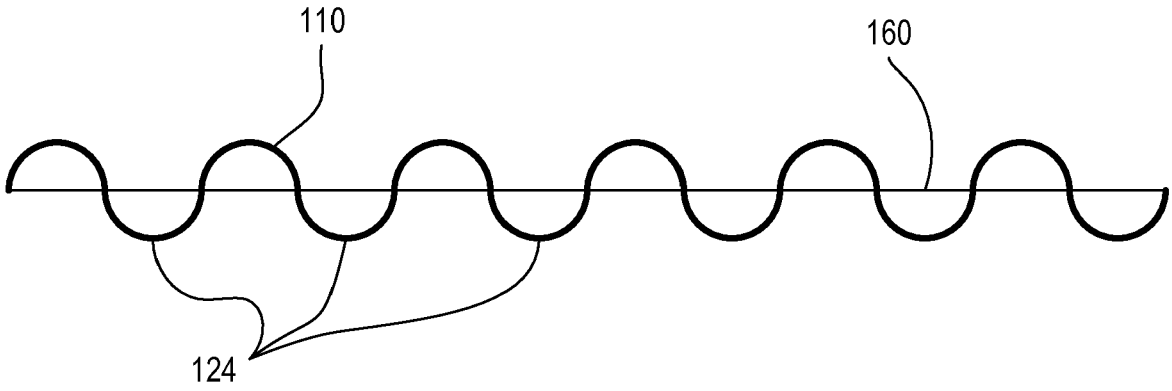
FIG. 6 is a simplified top cross sectional view of the shade fabric taken through the shade fabric.

FIG. 6 is a simplified top cross sectional view of shade fabric 110 hanging below the roller tube 112 taken through the shade fabric. As shown in FIG. 6, a tether 160 may be connected through the middle of the pleats 124 near the bottom edge 119 of the shade fabric 110. The tether 160 allows the shade fabric 110 to hang such that the pleats 124 are consistently formed and are spaced at predetermined distances from each other. Accordingly, approximately one half of the shade fabric 110 is located on one side of the tether 160, while the other half of the shade fabric is located on the other side of the tether. Additionally, a tether (not shown) may be similarly connected though the middle of the folds 126 near the top edge of the shade fabric 110 to assist in forming the fold as the shade fabric is initially wound around the roller tube 112.

FIG. 7 is a perspective view of a pleated roller shade system 200 according to a second embodiment of the present invention. The pleated roller shade system 200 comprises two mounting brackets 210 to which both the roller tube 112 and the pleating bar 120 are mounted. The motor drive unit 150 is housed inside the roller tube 112, which is rotatably mounted to two side portions 212 of the mounting brackets 210. Specifically, the motor drive unit 150 is coupled one of the side portions 212 via screws 214 received through attachment openings 216. Further, the pleating bar 120 is connected to the side portions 212 via attachment openings 218. The pleated roller shade system 200 may be mounted to a vertically-oriented wall via mounting holes 220 in rear portions 222 of the mounting brackets 210 or between the sides of an opening via mounting holes 224 in the side portions 212.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A roller shade system adapted to be mounted in front of a window, the roller shade system comprising:

a rotatably-mounted roller tube;

a flexible shade fabric windingly received around the roller tube and adapted to hang in front of the window, the shade fabric having a first fabric end connected to the roller tube and a second fabric end opposite the first fabric end, the second fabric end adapted to move in a vertical direction to raise and lower the shade fabric as the roller tube is rotated in respective first and second directions; and a pleating bar defining a fabric-receiving opening and mounted such that the shade fabric is received through the fabric-receiving opening, the fabric-receiving opening having a non-linear path, such that the shade fabric hangs in front of the window with a plurality of pleats;

wherein the second fabric end moves in an upward direction as the roller tube rotates in the first direction, and in a downward direction as the roller tube rotates in the second direction.

2. The roller shade system of claim 1, further comprising:

a pair of mounting brackets, the roller tube rotatably mounted between the pair of mounting brackets, such that the shade fabric extends from the roller tube through the fabric-receiving opening to the second fabric end and is adapted to hang in front of the window.

3. The roller shade system of claim 2, wherein the pleating bar comprises mounting ends for mounting the pleating bar below the roller tube, such that the shade fabric is received through the pleating bar and is adapted to hang in front of the window with the plurality of pleats.

4. The roller shade system of claim 3, wherein the mounting ends of the pleating bar are adapted to be mounted to a wall below the roller tube, such that the pleating bar is mounted parallel to the roller tube, and the shade fabric hangs through the pleating bar and in front of the window.

5. The roller shade system of claim 3, wherein the roller tube and the pleating bar are adapted to be mounted to a ceiling, such that the shade fabric hangs from the roller tube through the fabric-receiving opening to the second fabric end and in front of the window.

6. The roller shade system of claim 3, wherein the roller tube and the pleating bar are adapted to be mounted between the sides of the window, such that the shade fabric hangs from the roller tube through the fabric-receiving opening to the second fabric end and in front of the window.

7. The roller shade system of claim 2, further comprising:

a drive system for rotating the roller tube in the first and second directions.

8. The roller shade system of claim 7, wherein the drive system comprises a motor drive unit mounted inside the roller tube and rotatably mounted to the mounting brackets.

9. The roller shade system of claim 2, wherein the pleating bar is mounted between the mounting brackets.

10. The roller shade system of claim 1, wherein the shade fabric comprises a weighting element at the second fabric end.

11. The roller shade system of claim 10, wherein the shade fabric comprises a hem bar pocket at the second fabric end for holding the weighting element.

12. The roller shade system of claim 11, wherein the weighting element comprises a chain.

13. The roller shade system of claim 1, wherein the pleating bar comprises a plurality of pleating elements for causing the shade fabric to hang with the plurality of pleats.

14. The roller shade system of claim 13, wherein the pleating bar further comprises first and second support bars oriented parallel to each other along the length of the pleating bar, the pleating elements coupled to the first and second supports bars and extending towards the second and first support bars, respectively, the pleating elements each comprising a projection defining a T-shaped structure and spaced at intervals from each other along the respective support bars, the support bars mounted with respect to each other such that the fabric-receiving opening is formed between the pleating elements connected to the support bars, and the fabric-receiving opening forms a serpentine path.

15. The roller shade system of claim 1, wherein the plurality of pleats are coupled together with a tether near the second fabric end of the shade fabric.

16. The roller shade system of claim 1, wherein the pleating bar folds the shade fabric as the roller tube rotates in the first direction to raise the shade fabric end, such that the shade fabric is wrapped around the roller tube in folds.

17. A method of covering a window with a flexible shade fabric, the method comprising:

windingly receiving the flexible shade fabric around a rotatably-mounted roller tube, the shade fabric having a first fabric end connected to the roller tube and a second fabric end opposite the first fabric end;

receiving the shade fabric through a fabric-receiving opening of a pleating bar, the fabric-receiving opening having a non-linear path, such that the shade fabric hangs in front of the window with a plurality of pleats;

rotating the roller tube in a first direction to move the second fabric end in a vertical direction to raise the shade fabric; and rotating the roller tube in a second direction to move the second fabric end in the vertical direction to lower the shade fabric.

18. The method of claim 17, further comprising:

providing the second fabric end with a weighting element.

19. The method of claim 18, wherein providing the second fabric end with a weighting element comprises holding the weighting element in a hem bar pocket of the second fabric end.

20. The method of claim 17, further comprising:

folding the shade fabric as the roller tube rotates in the first direction to raise the shade fabric end through the pleating bar, such that the shade fabric is wrapped around the roller tube in folds.

* * * * *